US009709918B1

(12) United States Patent
Kuribayashi et al.

(10) Patent No.: US 9,709,918 B1
(45) Date of Patent: Jul. 18, 2017

(54) IMAGE FORMING APPARATUS USING BRILLIANT TONER HAVING METAL PIGMENT

(71) Applicant: FUJI XEROX CO., LTD., Tokyo (JP)

(72) Inventors: Masataka Kuribayashi, Kanagawa (JP); Takafumi Koide, Kanagawa (JP); Yusuke Fukuda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/254,234

(22) Filed: Sep. 1, 2016

(30) Foreign Application Priority Data

Feb. 25, 2016 (JP) ..... 2016-034680

(51) Int. Cl.
*G03G 15/08* (2006.01)

(52) U.S. Cl.
CPC ..... *G03G 15/08* (2013.01); *G03G 15/0806* (2013.01)

(58) Field of Classification Search
CPC ..... G03G 15/08; G03G 15/0806; G03G 15/0813; G03G 15/09
USPC ..... 399/267, 279
See application file for complete search history.

(56) References Cited

U.S. PATENT DOCUMENTS

2009/0129795 A1* 5/2009 Shimmura ..... G03G 15/0194 399/39
2009/0185834 A1* 7/2009 Hazeyama ..... G03G 15/0803 399/266
2010/0190101 A1* 7/2010 Shimmura ..... G03G 9/0819 430/111.41
2015/0111140 A1* 4/2015 Noguchi ..... G03G 9/08795 430/105
2015/0212458 A1* 7/2015 Nakajima ..... G03G 15/1675 399/313
2016/0259274 A1* 9/2016 Miyamoto ..... G03G 15/1605

FOREIGN PATENT DOCUMENTS

JP 2000221780 A * 8/2000
JP 2005-062476 A 3/2005

* cited by examiner

*Primary Examiner* — Robert Beatty
(74) *Attorney, Agent, or Firm* — Oliff PLC

(57) ABSTRACT

An image forming apparatus includes an image carrier; a charging device; an electrostatic image forming device that forms an electrostatic image; a developing device including a container that stores an electrostatic image developer containing a brilliant toner containing a substantially flake shape metal pigment, a developing member that is disposed so as to face, with a gap width, the image carrier and that develops the electrostatic image to form a toner image, and a voltage application unit, the apparatus satisfying $0.6\times10^{-13}C/\text{particle}\leq Q\leq3.0\times10^{-13}\ C/\text{particle}$ Formula (1):

$150\ g/m^2\ g/m^2\leq M\leq300\ g/m^2$ Formula (2):

$0.8\leq M/L\leq1.4$ Formula (3):

where Q represents a charge amount per particle [C/particle] of the brilliant toner, M represents an amount [$g/m^2$] of the electrostatic image developer carried by the developing member, and L represents the gap width [μm].

6 Claims, 2 Drawing Sheets

IMAGE FORMING APPARATUS USING BRILLIANT TONER HAVING METAL PIGMENT

CROSS-REFERENCE TO RELATED APPLICATIONS

This application is based on and claims priority under 35 USC 119 from Japanese Patent Application No. 2016-034680 filed Feb. 25, 2016.

BACKGROUND (i) Technical Field

The present invention relates to an image forming apparatus.

(ii) Related Art

The processes of visualizing image information such as an electrophotographic process are currently used in various technical fields. In the electrophotographic process, the surface of an image carrier is charged and an electrostatic image is formed as image information on the surface. A developer containing toner is used to form a toner image on this surface of the image carrier. This toner image is transferred onto a recording medium, and the toner image is fixed on the recording medium. These steps are performed to visualize image information as an image. The image carrier is cleaned with, for example, a blade and then used for forming another toner image.

SUMMARY

According to an aspect of the invention, there is provided an image forming apparatus including an image carrier;

a charging device that charges a surface of the image carrier;

an electrostatic image forming device that forms an electrostatic image on the surface of the image carrier;

a developing device including a container that stores an electrostatic image developer containing a brilliant toner containing a flake shape metal pigment or a substantially flake shape metal pigment, a developing member that is disposed so as to face, with a gap width, the image carrier and that develops the electrostatic image on the surface of the image carrier to form a toner image, and a voltage application unit that applies a direct current voltage to the developing member;

a transfer device that transfers the toner image on the surface of the image carrier onto a surface of a recording medium; and a fixing device that fixes the transferred toner image on the surface of the recording medium, the image forming apparatus satisfying relationships represented by Formulae (1) to (3) below $$0.6\times10^{-13}C/\text{particle}\leq Q\leq 3.0\times10^{-13}\ C/\text{particle} \quad \text{Formula (1):}$$

$$150\ \text{g/m}^2\leq M\leq 300\ \text{g/m}^2 \quad \text{Formula (2):}$$

$$0.8\leq M/L\leq 1.4 \quad \text{Formula (3):}$$

where Q represents a charge amount per particle [C/particle] of the brilliant toner, M represents an amount [g/m$^2$] of the electrostatic image developer carried by the developing member, and L represents the gap width [μm] between the image carrier and the developing member.

BRIEF DESCRIPTION OF THE DRAWINGS

Exemplary embodiments of the present invention will be described in detail based on the following figures, wherein.

DETAILED DESCRIPTION

Figure 1:
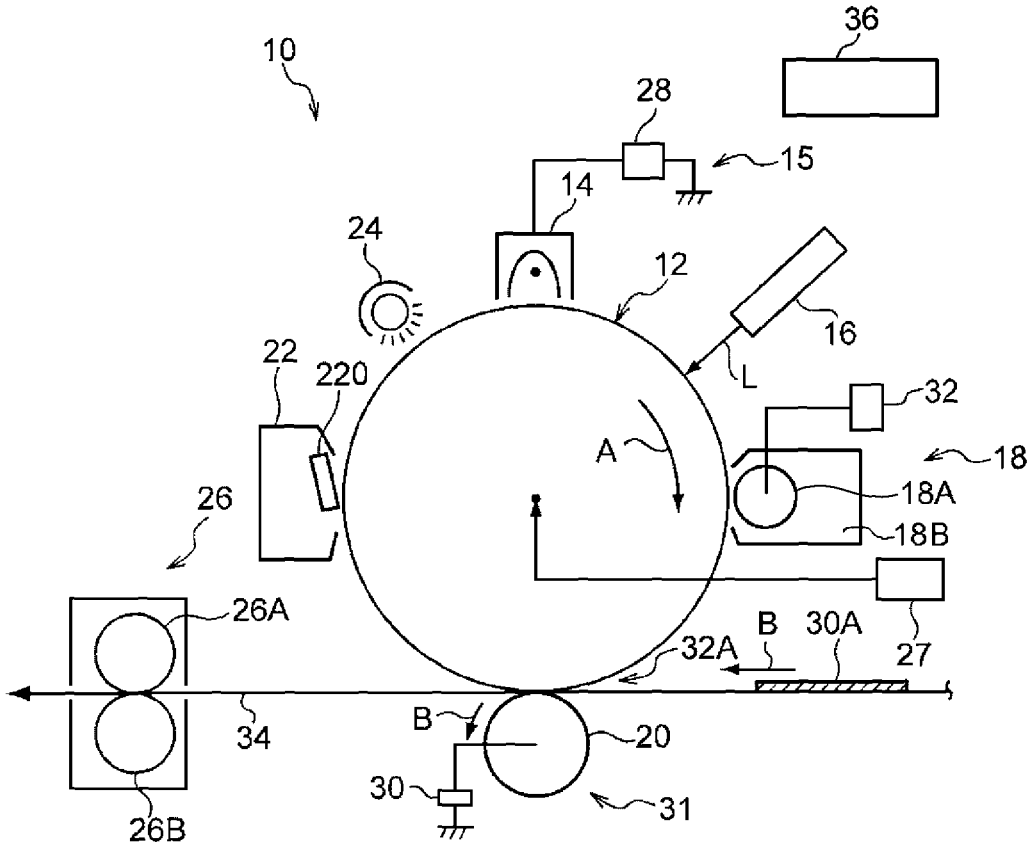
FIG. 1 is a schematic diagram illustrating the configuration of an image forming apparatus according to an exemplary embodiment.

Hereinafter, an exemplary embodiment that is an example of the present invention will be described in detail.

An image forming apparatus according to an exemplary embodiment includes an image carrier; a charging device that charges the surface of the image carrier; an electrostatic image forming device that forms an electrostatic image on the charged surface of the image carrier; a developing device that stores an electrostatic image developer (hereafter, also referred to as the "developer") containing a brilliant toner (hereafter, also referred to as the "toner") containing a flake shape metal pigment or a substantially flake shape metal pigment, and that uses the developer to develop the electrostatic image on the surface of the image carrier to form a toner image; a transfer device that transfers the toner image on the surface of the image carrier onto the surface of a recording medium; and a fixing device that includes a fixing member and a press member disposed in contact with the fixing member, and that fixes, in the contact area between the fixing member and the press member, the transferred toner image on the surface of the recording medium.

The developing device includes a container that stores the electrostatic image developer; a developing member that is disposed so as to face, with a gap width, the image carrier, and that carries the electrostatic image developer to a developing region facing the image carrier, to develop the electrostatic image on the surface of the image carrier to form a toner image; and a voltage application unit that applies a direct current voltage to the developing member.

The image forming apparatus also satisfies the relationships represented by Formulae (1) to (3) below, $$0.6\times10^{-13}C/\text{particle}\leq Q\leq 3.0\times10^{-13}\ C/\text{particle} \quad \text{Formula (1):}$$

$$150\ \text{g/m}^2\leq M\leq 300\ \text{g/m}^2 \quad \text{Formula (2):}$$

$$0.8\leq M/L\leq 1.4 \quad \text{Formula (3):}$$

where Q represents the charge amount per particle [C/particle] of the brilliant toner; M represents the amount [g/m$^2$] of the electrostatic image developer carried by the developing member; and L represents the gap width [μm] between the image carrier and the developing member.

In order to obtain brilliant fixed images, the brilliant toner containing such a flat metal pigment is used. Since the brilliant toner contains the flake shape metal pigment, the toner tends to have a large particle size. A large particle size results in a decrease in the charge amount per particle of the toner. On the other hand, an increase in the charge amount per particle of the toner results in a decrease in the developing amount. In the case of employing a developing system of applying a direct current voltage to a developing member, for the purpose of increasing the intensity of the developing electric field to increase the developing amount, the gap width between the image carrier and the developing member is decreased. Such a narrow gap between the image carrier and the developing member sometimes blocks the electrostatic image developer containing the brilliant toner (hereafter, this phenomenon is also referred to as "jamming").

In order to address the jamming, the image forming apparatus according to the exemplary embodiment is provided so as to satisfy Formulae (1) to (3) above by adjusting the charge amount Q per particle [C/particle] of the brilliant toner, the amount M [g/m$^2$] of the electrostatic image developer carried by the developing member, and the gap width L [μm] between the image carrier and the developing member. As a result, in the case of employing the developing system of applying a direct current voltage to the developing member, even when the gap width between the image carrier and the developing member is decreased, a developing amount is ensured that is appropriate for imparting high reflectivity to fixed images in accordance with the charge amount of the brilliant toner, and occurrence of jamming is also suppressed in the gap between the image carrier and the developing member.

Thus, the image forming apparatus according to the exemplary embodiment enables suppression of occurrence of jamming and also formation of highly brilliant fixed images.

The image forming apparatus according to the exemplary embodiment, which satisfies Formulae (1) to (3) above, preferably satisfies Formulae (11) to (13) below from the viewpoint of suppressing occurrence of jamming and increasing the reflectivity of fixed images.

$1.0\times10^{-13}C/\text{particle}\leq Q\leq 2.5\times10^{-13}\ C/\text{particle}$(or $Q$ is about $1.0\times10^{-13}C$/particle to about $2.5\times10^{-13}C$/particle) Formula (11):

$175\ \text{g/m}^2\leq M\leq 275\ \text{g/m}^2$(or $M$ is about 175 g/m$^2$ to about 275 g/m$^2$) Formula (12):

$0.85\leq M/L\leq 1.3$ Formula (13):

In addition, from the viewpoint of suppressing occurrence of jamming and increasing the reflectivity of fixed images, the gap width L between the image carrier and the developing member preferably satisfies 150 μm≤L≤300 μm (or about 150 μm to about 300 μm), more preferably 175 μm≤L≤275 μm.

The charge amount Q per particle of the brilliant toner may be controlled by, for example, 1) a method of adjusting the particle size, 2) an adjustment method using a carrier, or 3) an adjustment method using an external additive.

The charge amount Q per particle of the brilliant toner is measured in the following manner.

The developer is placed into a cylindrical Faraday cage equipped with metal meshes at both ends. The opening size of the metal meshes is smaller than the particle size of the carrier of the developer, which enables the toner alone to pass through the cage. A high-pressure gas is used to separate the toner from the surfaces of the carrier. The charge amount generated at this time is measured with an electrometer, and divided by the weight of the separated toner to determine the charge amount per weight (C/g). The number of particles of the toner per weight is calculated from the particle size and specific gravity. The charge amount per weight is used to calculate the charge amount per particle of the toner.

The amount M of the electrostatic image developer carried by the developing member may be controlled by, for example, 1) an adjustment method using a developer-layer restricting member, 2) a method of adjusting the surface profile of the developing member, or 3) an adjustment method using a magnetic force exerted by the developing member.

The amount M of the electrostatic image developer carried by the developing member is measured in the following manner.

The developer carried on the surface of the developing member is partially masked with a suction mask jig for masking a certain area. The masked portion of the developer is sucked with the developer suction jig connected to the end of a suction pump. The developer carrying amount is calculated from the weights of the jig before and after the suction. The developer carrying amount is divided by the area of the masked portion to determine the weight of the developer per unit area (amount M).

Figure 2:
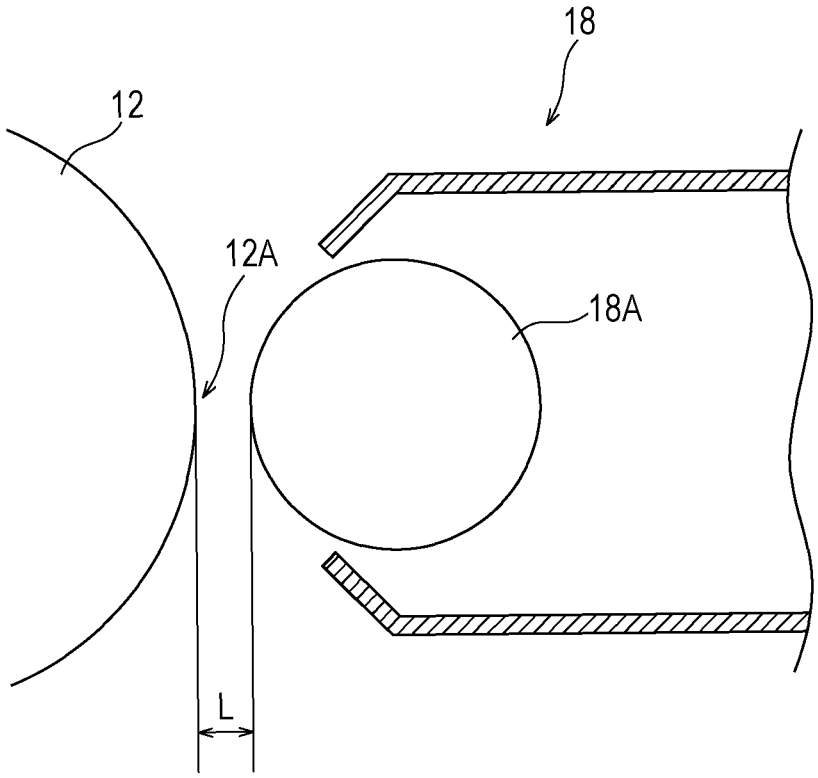
FIG. 2 is an enlarged schematic diagram illustrating the configuration of a developing device and a relating component in the image forming apparatus according to the exemplary embodiment.

The gap width L between the image carrier and the developing member is the minimum distance between the image carrier and the developing member, which are disposed so as to face each other (refer to FIG. 2). Incidentally, FIG. 2 illustrates a photoconductor 12, which is an example of the image carrier, a developing device 18, and a developing member 18A.

The image forming apparatus according to the exemplary embodiment is applicable to well-known image forming apparatuses: for example, a direct transfer apparatus, which directly transfers a toner image formed on the surface of an image carrier onto a recording medium; an intermediate transfer apparatus, which performs first transfer of transferring a toner image formed on the surface of an image carrier onto the surface of an intermediate transfer body, and performs second transfer of transferring the transferred toner image on the surface of the intermediate transfer body onto the surface of a recording medium; and an apparatus equipped with a discharging device, which irradiates the surface of an image carrier that has transferred a toner image and is to be charged, with discharging light to discharge the image carrier. In the case of the intermediate transfer apparatus, the transfer device includes, for example, an intermediate transfer body onto the surface of which a toner image is transferred; a first transfer unit that performs first transfer of transferring the toner image formed on the surface of the image carrier onto the surface of the intermediate transfer body; and a second transfer unit that performs second transfer of transferring the transferred toner image on the surface of the intermediate transfer body onto the surface of a recording medium.

Incidentally, the image forming apparatus according to the exemplary embodiment may include a cartridge structure (process cartridge) that includes, for example, at least the image carrier and that is detachably attached to the image forming apparatus.

Hereinafter, a non-limiting example of the image forming apparatus according to the exemplary embodiment will be described. Incidentally, the image forming apparatus will be described in terms of components illustrated in the drawings and the description of the other components will be omitted.

FIG. 1 is a schematic diagram illustrating the configuration of the image forming apparatus according to the exemplary embodiment.

Referring to FIG. 1, an image forming apparatus 10 according to the exemplary embodiment includes, for example, an electrophotographic photoconductor (an example of the image carrier; hereafter referred to as the "photoconductor") 12. The photoconductor 12 is a cylindrical member connected to a driving unit 27 such as a motor via a driving-force transmission member (not shown) such as a gear. In the example in FIG. 1, the driving unit 27 drivingly rotates the photoconductor 12 in the direction of arrow A around a rotation shaft represented by a black dot.

The photoconductor 12 is surrounded by, for example, the following devices sequentially arranged in the rotation direction of the photoconductor 12: a charging device 15, an electrostatic image forming device 16, a developing device 18, a transfer device 31, a cleaning device 22, and a discharging device 24. The image forming apparatus 10 further includes a fixing device 26, which includes a fixing member 26A and a press member 26B, which is disposed in contact with the fixing member 26A. The image forming apparatus 10 further includes a controller 36, which controls operations of devices (units).

The image forming apparatus 10 may include a process cartridge including at least the photoconductor 12 combined with another device to constitute a single structure.

Hereinafter, devices (units) of the image forming apparatus 10 will be described in detail.

Photoconductor

The photoconductor 12 includes, for example, a conductive base member, an undercoating layer formed on the conductive base member, and a photosensitive layer formed on the undercoating layer. The photosensitive layer may have a bilayer structure constituted by a charge generation layer and a charge transport layer. The photosensitive layer may be an organic photosensitive layer or an inorganic photosensitive layer. The photoconductor 12 may further include a protective layer on the photosensitive layer.

Charging Device

The charging device 15 charges the surface of the photoconductor 12. The charging device 15 includes, for example, a charging member 14, which is disposed in contact with or not in contact with the surface of the photoconductor 12 and charges the surface of the photoconductor 12, and a power source 28 (an example of the voltage application unit for the charging member), which applies a charging voltage to the charging member 14. The power source 28 is electrically connected to the charging member 14.

The charging member 14 of the charging device 15 is, for example, a contact-type charger employing a conductive member such as a charging roller, a charging brush, a charging film, a charging rubber blade, or a charging tube. Other examples of the charging member 14 include non-contact-type roller chargers, and known chargers employing corona discharge such as scorotron chargers and corotron chargers.

The charging device 15 (including the power source 28) is, for example, electrically connected to the controller 36 of the image forming apparatus 10. The controller 36 controls the charging device 15 such that the power source 28 applies a charging voltage to the charging member 14. The charging member 14 in turn charges the photoconductor 12 to a charging potential according to the applied charging voltage. The power source 28 may be adjusted to apply different charging voltages, to thereby charge the photoconductor 12 to different charging potentials.

Electrostatic Image Forming Device

The electrostatic image forming device 16 forms an electrostatic image on the charged surface of the photoconductor 12. Specifically, the electrostatic image forming device 16 is, for example, electrically connected to the controller 36 of the image forming apparatus 10. The controller 36 controls the electrostatic image forming device 16 to apply light L, which is modulated in accordance with the image information of an image to be formed, to the surface (charged by the charging member 14) of the photoconductor 12. As a result, an electrostatic image corresponding to the image information of the image is formed on the photoconductor 12.

Examples of the electrostatic image forming device 16 include optical devices equipped with light sources and enabling imagewise exposure with light such as semiconductor laser light, LED light, or liquid crystal shutter light.

Developing Device

The developing device 18 is disposed, for example, in a downstream position, in the rotation direction of the photoconductor 12, with respect to the position where light L is applied by the electrostatic image forming device 16. The developing device 18 includes a container 18B, which stores the developer. The container 18B stores the developer containing a brilliant toner (hereafter, also simply referred to as the "toner") containing a flake shape metal pigment. The toner is stored, for example, in the charged state within the developing device 18. The brilliant toner containing a flake shape metal pigment will be described later in detail.

The developing device 18 further includes, for example, a developing member 18A, which develops, with the toner-containing developer, the electrostatic image on the surface of the photoconductor 12; and a power source 32 (an example of the voltage application unit), which applies a direct current voltage (developing voltage) to the developing member 18A. The developing member 18A is, for example, electrically connected to the power source 32.

The developing member 18A of the developing device 18 is disposed so as to face, with a gap width, the photoconductor 12. The developing member 18A carries the developer to a developing region 12A, which faces the photoconductor 12, so that the electrostatic image formed on the surface of the photoconductor 12 is developed to provide a toner image (refer to FIG. 2).

The developing member 18A of the developing device 18 is selected in accordance with the type of developer. The developing member 18A is, for example, a developing roller including a magnet-embedded developing sleeve.

The developing device 18 (including the power source 32) is, for example, electrically connected to the controller 36 of the image forming apparatus 10. The controller 36 controls the developing device 18 to apply a direct current voltage as the developing voltage to the developing member 18A. The developing member 18A to which the direct current voltage is applied as the developing voltage is thus charged to a developing potential according to the developing voltage. The developing member 18A charged to the developing potential, for example, holds, on its surface, the developer stored within the developing device 18, and supplies the toner contained in the developer from the developing device 18 to the surface of the photoconductor 12.

Incidentally, the direct current voltage (absolute value) applied to the developing member 18A is, from the viewpoint of suppressing occurrence of jamming and increasing the reflectivity of fixed images, preferably 50 V or more and 600 V or less, more preferably 100 V or more and 500 V or less.

The toner supplied onto the photoconductor 12 adheres to the electrostatic image on the photoconductor 12 by an electrostatic force, for example. Specifically, for example, the toner contained in the developer is supplied to the electrostatic-image-formed region of the photoconductor 12 by a potential difference in the developing region 12A where the photoconductor 12 and the developing member 18A face each other, in other words, the potential difference in the region between the surface potential of the photoconductor 12 and the developing potential of the developing member 18A. Incidentally, when the developer contains a carrier, the carrier is continuously held on the developing member 18A and returned into the developing device 18.

For example, the electrostatic image on the photoconductor 12 is developed with the toner supplied by the developing member 18A. As a result, a toner image corresponding to the electrostatic image is formed on the photoconductor 12.

Transfer Device

The transfer device 31 is disposed, for example, in a downstream position, in the rotation direction of the photoconductor 12, with respect to the developing member 18A. The transfer device 31 includes, for example, a transfer member 20, which transfers the toner image on the surface of the photoconductor 12 onto a recording medium 30A; and a power source 30, which applies a transfer voltage to the transfer member 20. The transfer member 20 is, for example, a cylindrical member that transports the recording medium 30A by pinching it between the cylindrical member and the photoconductor 12. The transfer member 20 is, for example, electrically connected to the power source 30.

Examples of the transfer member 20 include contact-type transfer chargers employing, for example, a belt, a roller, a film, or a rubber blade; and known non-contact-type transfer chargers such as scorotron transfer chargers and corotron transfer chargers, which employ corona discharge.

The transfer device 31 (including the power source 30) is, for example, electrically connected to the controller 36 of the image forming apparatus 10. The controller 36 controls the transfer device 31 to apply a transfer voltage to the transfer member 20. The transfer member 20 to which the transfer voltage is applied is thus charged to a transfer potential according to the transfer voltage.

A transfer voltage having a polarity opposite to the polarity of the toner forming the toner image on the photoconductor 12 is applied by the power source 30 to the transfer member 20. As a result, for example, in a region (transfer region 32A in FIG. 1) where the photoconductor 12 and the transfer member 20 face each other, a transfer electric field is formed that has an intensity enabling transfer of toner particles forming the toner image on the photoconductor 12 onto the transfer member 20 by an electrostatic force.

The recording medium 30A is, for example, stored in a container (not shown). The recording medium 30A is transported from the container along a transport path 34 by plural transport members (not shown), to reach the transfer region 32A, where the photoconductor 12 and the transfer member 20 face each other. In the example in FIG. 1, the recording medium 30A is transported in the direction of arrow B. For example, a transfer voltage is applied to the transfer member 20 to form a transfer electric field in the transfer region 32A, and this transfer electric field causes transfer of the toner image on the photoconductor 12 onto the recording medium 30A having reached the transfer region 32A. In other words, for example, the toner is moved from the surface of the photoconductor 12 to the recording medium 30A, so that the toner image is transferred onto the recording medium 30A.

The toner image on the photoconductor 12 is thus transferred onto the recording medium 30A by the transfer electric field. The intensity of the transfer electric field is controlled on the basis of a transfer current value. The transfer current value is the value of current measured in the transfer device 31 during application of a transfer electric field under constant current control. The transfer current value represents the intensity of the transfer electric field. For example, the transfer current value is 10 μA or more and 45 μA or less.

Cleaning Device

The cleaning device 22 is disposed, for example, in a downstream position, in the rotation direction of the photoconductor 12, with respect to the transfer region 32A. After a toner image is transferred onto the recording medium 30A, the cleaning device 22 cleans off residual toner adhering to the photoconductor 12. The cleaning device 22 cleans off, in addition to residual toner, adhering matter such as paper dust.

The cleaning device 22 includes, for example, a cleaning blade 220, which is in contact with the photoconductor 12 at a predetermined line pressure. The cleaning blade 220 is in contact with the photoconductor 12 at a line pressure of, for example, 10 g/cm or more and 150 g/cm or less.

Discharging Device

The discharging device 24 is disposed, for example, in a downstream position, in the rotation direction of the photoconductor 12, with respect to the cleaning device 22. After transfer of a toner image, the discharging device 24 discharges the surface of the photoconductor 12 by exposure to light. Specifically, for example, the discharging device 24 is electrically connected to the controller 36 of the image forming apparatus 10; and the controller 36 controls the discharging device 24 to expose the whole surface of the photoconductor 12 (specifically, for example, the whole surface of the image-formed region) to light to thereby discharge the surface.

Examples of the discharging device 24 include devices equipped with light sources such as tungsten lamps that emit white light and light-emitting diodes (LEDs) that emit red light.

Fixing Device

The fixing device 26 is disposed, for example, in a downstream position, in the transport direction of the recording medium 30A along the transport path 34, with respect to the transfer region 32A. The fixing device 26 includes a fixing member 26A and a press member 26B, which is disposed in contact with the fixing member 26A. The transferred toner image on the recording medium 30A is fixed in a contact area between the fixing member 26A and the press member 26B. Specifically, the fixing device 26 is, for example, electrically connected to the controller 36 of the image forming apparatus 10. The controller 36 controls the fixing device 26 to fix, by heat and pressure, the transferred toner image on the recording medium 30A.

Examples of the fixing device 26 include known fixing devices such as thermal roller fixing devices and oven fixing devices.

Specifically, the fixing device 26 is, for example, a well-known fixing device that includes a fixing roller or fixing belt as the fixing member 26A and a press roller or press belt as the press member 26B.

As described above, the recording medium 30A is transported along the transport path 34 and subjected to transfer of the toner image while passing through the region (transfer region 32A) where the photoconductor 12 and the transfer member 20 face each other. The recording medium 30A is, for example, further transported along the transport path 34 by transport members (not shown) to the location of the fixing device 26, where the toner image on the recording medium 30A is fixed.

The recording medium 30A having an image formed by fixing of the toner image, is output by plural transport members (not shown) to the outside of the image forming apparatus 10. Incidentally, the photoconductor 12 discharged by the discharging device 24 is charged again to the charging potential by the charging device 15.

Controller

The controller 36 is provided as a computer that controls the whole apparatus and performs various mathematical operations. Specifically, the controller includes, for example, the following components (not shown): a CPU (Central Processing Unit), a ROM (Read Only Memory) storing various programs, a RAM (Random Access Memory) used as a work area during program execution, a nonvolatile memory storing various data items, and input/output interfaces (I/O). The CPU, ROM, RAM, nonvolatile memory, and I/O are connected via a bus.

The image forming apparatus 10 further includes, in addition to the controller 36, the following units (not shown): an operation display, an image processing unit, an image memory, an image forming unit, a memory, and a communication unit. These units of the operation display, the image processing unit, the image memory, the image forming unit, the memory, and the communication unit are connected to the I/O of the controller 36. The controller 36 exchanges data with and controls these units of the operation display, the image processing unit, the image memory, the image forming unit, the memory, and the communication unit.

Incidentally, the controller 36 may be connected to various drives that are devices with which data is read from computer-readable portable recording media such as flexible disks, magneto-optical disks, CD-ROMs, DVD-ROMs, and USB memories, and with which data is written into such recording media. When the controller 36 is equipped with various drives, a control program may be stored in a portable recording medium, and the control program may be read and executed with a corresponding drive.

Operations of Image Forming Apparatus

Hereinafter, a description will be made regarding an example of operations of the image forming apparatus 10 according to the exemplary embodiment. Incidentally, various operations of the image forming apparatus 10 are performed by control programs executed in the controller 36.

The image forming apparatus 10 includes, for example, control programs "image forming processing" and "fixed-image reflectivity adjustment processing", which are pre-stored in a ROM 36B. The pre-stored control programs are read by a CPU 36A and executed in a RAM 36C as a work area. The image forming apparatus 10 also includes, for example, various data items such as "image forming conditions (various process control values)", which are pre-stored in the nonvolatile memory. Alternatively, such control programs and various data items may be stored in other memory units such as the ROM, the nonvolatile memory, and the memory, or obtained from the outside via the communication unit.

The image forming operation of the image forming apparatus 10 will be first described. The image forming operation is performed by the control program "image forming processing" executed in the controller 36.

The surface of the photoconductor 12 is first charged by the charging device 15. The electrostatic image forming device 16 exposes, to light, the charged surface of the photoconductor 12 in accordance with image information. As a result, an electrostatic image corresponding to the image information is formed on the photoconductor 12. The developing device 18 develops the electrostatic image on the surface of the photoconductor 12 with a developer containing a toner. As a result, a toner image is formed on the surface of the photoconductor 12. The transfer device 31 transfers the toner image on the surface of the photoconductor 12 onto the recording medium 30A. The transferred toner image on the recording medium 30A is fixed by the fixing device 26. On the other hand, the surface of the photoconductor 12 from which the toner image has been transferred is cleaned by the cleaning device 22 and discharged by the discharging device 24.

Brilliant-Toner-Containing Developer

Hereinafter, the developer containing a brilliant toner will be described. The brilliant toner will be first described.

Brief Description of Brilliant Toner

The brilliant toner contains a flake shape metal pigment (hereafter also referred to as the "metal pigment"). Specifically, the brilliant toner contains toner particles containing the metal pigment. The brilliant toner, which contains toner particles containing the metal pigment, reflects light to exhibit reflectivity: The terms "brilliant" and "reflectivity" mean that an image formed from the brilliant toner is seen as having brilliance such as a metallic luster.

The metal pigment has a large particle size and has a flake shape (flat-plate shape). Thus, toner particles containing the metal pigment also have a flake shape. The toner particles, which contain the flake shape metal pigment, may have an average long-axis length of 7 μm or more and 20 μm or less and an average thickness of 1 μm or more and 3 μm or less. The shapes of the metal pigment and the toner particles containing the metal pigment will be described later in detail.

Reflectivity

Hereinafter, the term "reflectivity" will be described further in detail.

The brilliant toner preferably satisfies a ratio A/B of 2 or more and 100 or less where, when a solid image formed from the brilliant toner is measured with a variable angle photometer while being irradiated with incident light at an incident angle of −45°, A represents a reflectance measured at a light receiving angle of +30° and B represents a reflectance measured at a light receiving angle of −30°.

When the ratio A/B is 2 or more, reflection of the incident light tends to go to, rather than the incident side (negative angle side), the other side (positive angle side) opposite to the incident side. In other words, diffused reflection of the incident light is suppressed. When diffused reflection, which is reflection of incident light in random directions, occurs, the reflected light is seen as a dull color. Thus, when the ratio A/B is less than 2, the reflected light may show no luster and the reflectivity may be low.

On the other hand, when the ratio A/B is more than 100, the angle of visibility where the reflected light is observable may become excessively narrow and the large regular reflection component may cause the image to appear dark depending on the viewing angle. In addition, toners satisfying a ratio A/B of more than 100 are difficult to produce.

Incidentally, the ratio A/B is more preferably 50 or more and 100 or less, still more preferably 60 or more and 90 or less, particularly preferably 70 or more and 80 or less.

Measurement of Ratio A/B with Variable Angle Photometer

The incident angle and the light receiving angles will be first described. In the exemplary embodiment, the measurement with a variable angle photometer is performed at an incident angle of −45°. This is because images having glossiness over a wide range are measured with high sensitivity. The measurement is performed also at light receiving angles of −30° and +30°. This is because reflective images and non-reflective images are identified with high sensitivity.

Hereinafter, how to measure the ratio A/B will be described.

In order to measure the ratio A/B in the exemplary embodiment, a "solid image" is first prepared in the following manner. The developer as the sample is charged into the developing device of a DOCUCENTRE-III C7600, manufactured by Fuji Xerox Co., Ltd. This apparatus is used to form a solid image (having a toner application amount of 4.5 $g/m^2$) on a recording paper sheet (OK TOPCOAT+, manufactured by Oji Paper Co., Ltd.) at a fixing temperature of 190° C. and a fixing pressure of 4.0 $kg/cm^2$. Incidentally, the term "solid image" denotes an image with a coverage rate of 100%.

The image portion of the solid image is measured with a variable angle photometer that is a spectroscopic variable-angle color-difference meter GC5000L, manufactured by NIPPON DENSHOKU INDUSTRIES CO., LTD. Specifically, the solid image is irradiated with incident light at an incident angle of −45°, and a reflectance A at a light receiving angle of +30° and a reflectance B at a light receiving angle of −30° are measured. Incidentally, the reflectance A and the reflectance B are each measured with light of wavelengths of 400 nm to 700 nm in steps of 20 nm, and determined as the average of the measured reflectances at the individual wavelengths. From the measurement results, the ratio A/B is calculated.

Incidentally, the ratio A/B is the flop index (FI), which is measured in accordance with ASTM E2194 as an index representing the degree of metallic luster.

Composition of Toner

Hereinafter, the composition of the brilliant toner will be described.

The brilliant toner contains toner particles containing a metal pigment. The brilliant toner may optionally contain external additives. The toner particles containing a metal pigment contain the metal pigment, a binder resin, and optionally a release agent and other additives. Hereinafter, the metal pigment, the binder resin, the release agent, and the other additives will be described.

Metal Pigment

Examples of the metal pigment include powders of metals such as aluminum, brass, bronze, nickel, and zinc. The metal pigment may be a coated pigment prepared by coating the surfaces of such metal pigment particles with at least one metal oxide selected from the group consisting of silica, alumina, and titania.

In particular, the metal pigment preferably contains aluminum (Al), which is, for example, readily available and easily processed into flake shapes. When the metal pigment is such an Al-containing pigment, the metal pigment preferably has an Al content of 40 mass % or more and 100 mass % or less, more preferably 60 mass % or more and 98 mass % or less.

The metal pigment preferably has an average long-axis length of 5 μm or more and 12 μm or less, or about 5 μm or more and about 12 μm or less and has an average thickness of 0.01 μm or more and 0.5 μm or less, or about 0.01 μm or more and about 0.5 μm or less. The long-axis length of the metal pigment denotes the largest length of the metal pigment when the metal pigment is viewed in the thickness direction of the metal pigment. The thickness of the metal pigment denotes the largest length of the metal pigment when the metal pigment is viewed in a direction orthogonal to the thickness direction of the metal pigment.

When the metal pigment has an average long-axis length of less than 5 μm, the brilliant toner may tend not to exhibit reflectivity. When the metal pigment has an average long-axis length of more than 12 μm, the toner may become difficult to produce. The metal pigment preferably has an average long-axis length of 5 μm or more and 12 μm or less, more preferably 5 μm or more and 9 μm or less.

When the metal pigment has an average thickness of less than 0.01 μm, deformation or shrinkage of the metal pigment may cause a decrease in the reflectivity. When the metal pigment has an average thickness of more than 0.5 μm, the brilliant toner may tend not to exhibit reflectivity. The metal pigment preferably has an average thickness of 0.01 μm or more and 0.5 μm or less, more preferably 0.01 μm or more and 0.3 μm or less.

The average long-axis length and average thickness of the metal pigment are determined in the following manner: a micrograph of 50 particles of the metal pigment is taken with a scanning electron microscope (SEM); these particles on the micrograph are measured for long-axis length and thickness, and the measured values are averaged.

In the brilliant toner, the metal pigment content relative to 100 parts by mass of the binder resin is preferably 1 part by mass or more and 70 parts by mass or less, more preferably 5 parts by mass or more and 50 parts by mass or less.

Binder Resin

Examples of the binder resin include vinyl resins that are homopolymers of monomers and copolymers of two or more species of monomers. Examples of the monomers include styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene).

Other examples of the binder resin include non-vinyl resins such as epoxy resins, polyester resins, polyurethane resins, polyamide resins, cellulose resins, polyether resins, and modified rosin; mixtures of such non-vinyl resins and the above-described vinyl resins; and graft polymers synthesized by polymerizing vinyl monomers in the presence of the foregoing. Such binder resins may be used alone or in combination of two or more thereof.

The binder resin is preferably a polyester resin. Examples of the polyester resin include known polyester resins. The polyester resin is, for example, a polycondensate of a polycarboxylic acid and a polyhydric alcohol. Incidentally, amorphous polyester resins may be commercially available products or may be synthesized.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides of the foregoing, and lower alkyl (having, for example, 1 or more and 5 or less carbon atoms) esters of the foregoing. Of these, preferred examples of the polycarboxylic acid are aromatic dicarboxylic acids.

As the polycarboxylic acid, a dicarboxylic acid may be used in combination with a carboxylic acid that has three or more carboxy groups and provides a cross-linked structure or a branched structure. Examples of the carboxylic acid having three or more carboxy groups include trimellitic acid and pyromellitic acid, anhydrides of the foregoing, and lower alkyl (having, for example, 1 or more and 5 or less carbon atoms) esters of the foregoing. Such polycarboxylic acids may be used alone or in combination of two or more thereof.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as ethylene oxide adducts of bisphenol A and propylene oxide adducts of bisphenol A). Of these, preferred examples of the polyhydric alcohol are aromatic diols and alicyclic diols, more preferably aromatic diols.

As the polyhydric alcohol, a diol may be used in combination with a polyhydric alcohol that has three or more hydroxy groups and provides a cross-linked structure or a branched structure. Examples of the polyhydric alcohol having three or more hydroxy groups include glycerol, trimethylolpropane, and pentaerythritol. Such polyhydric alcohols may be used alone or in combination of two or more thereof.

The polyester resin preferably has a glass transition temperature (Tg) of 50° C. or more and 80° C. or less, more preferably 50° C. or more and 65° C. or less. The glass transition temperature is determined from a differential scanning calorimetry (DSC) curve obtained by DSC. More specifically, the glass transition temperature is determined in accordance with "extrapolated glass transition onset temperature" described in "How to Determine Glass Transition Temperature" in JIS K7121-1987 "Testing Methods for Transition Temperatures of Plastics".

The polyester resin preferably has a weight-average molecular weight (Mw) of 5000 or more and 1000000 or less, more preferably 7000 or more and 500000 or less. The polyester resin preferably has a number-average molecular weight (Mn) of 2000 or more and 100000 or less. The polyester resin preferably has a molecular weight distribution Mw/Mn of 1.5 or more and 100 or less, more preferably 2 or more and 60 or less.

Incidentally, the weight-average molecular weight and the number-average molecular weight are measured by gel permeation chromatography (GPC). This molecular weight measurement by GPC employs, as the measurement instrument, a GPC•HLC-8120 manufactured by Tosoh Corporation, a column TSKGEL Super HM-M (15 cm) manufactured by Tosoh Corporation, and a THF solvent. The weight-average molecular weight and the number-average molecular weight are calculated from the measurement results with molecular weight calibration curves created with monodisperse polystyrene standards.

The polyester resin may be produced by a well-known method. Specifically, for example, polymerization may be performed in a temperature range of 180° C. or more and 230° C. or less, optionally at a reduced pressure in the reaction system, while water and alcohol generated during condensation are removed.

Incidentally, when a monomer as a starting material is not soluble or miscible at the reaction temperature, a solvent having a high boiling point may be added as a solubilizing agent to dissolve the monomer. In this case, the polycondensation reaction is performed while the solubilizing agent is distilled off. In the case of a copolymerization reaction involving a monomer having low miscibility, condensation may be performed between this low-miscibility monomer and an acid or alcohol for polycondensation with the monomer, and the resultant condensate and the main component may be subjected to polycondensation.

The binder resin content relative to the whole toner particles containing a metal pigment is, for example, preferably 40 mass % or more and 95 mass % or less, more preferably 50 mass % or more and 90 mass % or less, still more preferably 60 mass % or more and 85 mass % or less.

Release Agent

Non-limiting examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters.

The release agent preferably has a melting temperature of 50° C. or more and 110° C. or less, more preferably 60° C. or more and 100° C. or less. Incidentally, the melting temperature is determined from a differential scanning calorimetry (DSC) curve obtained by DSC, as the "peak melting temperature" described in "How to Determine Melting Temperature" in JIS K7121:1987 "Testing Methods for Transition Temperatures of Plastics".

The release agent content relative to the whole toner particles is, for example, preferably 1 mass % or more and 20 mass % or less, more preferably 5 mass % or more and 15 mass % or less.

Other Additives

Examples of the other additives include well-known additives such as charge control agents and inorganic powders. Such additives are contained, as internal agents, in the toner particles.

Shape of Toner Particles

Hereinafter, the shape of toner particles will be described. As described above, the toner particles containing the metal pigment have a "flake shape" depending on the shape of the metal pigment.

The toner particles containing the metal pigment (hereafter, in the description of the shape of toner particles, referred to as "brilliant toner particles") preferably have an average long-axis length of 7 μm or more and 20 μm or less, and an average thickness of 1 μm or more and 3 μm or less.

The brilliant toner particles have an average long-axis length of 7 μm or more and 20 μm or less and an average thickness of 1 μm or more and 3 μm or less. The long-axis length of such a brilliant toner particle denotes the largest length of the brilliant toner particle when this particle is viewed in its thickness direction. The thickness of the brilliant toner particle denotes the largest length of the brilliant toner particle when this particle is viewed in a direction orthogonal to the thickness direction of the particle.

When the brilliant toner particles have an average long-axis length of less than 7 μm, sufficient reflectivity may not be provided. When the brilliant toner particles have an average long-axis length of more than 20 μm, the resultant images may have graininess and high granularity. The brilliant toner particles preferably have an average long-axis length of 7 μm or more and 20 μm or less, more preferably 8 μm or more and 15 μm or less.

When the brilliant toner particles have an average thickness of less than 1 μm, the brilliant toner particles may have low fluidity. When the brilliant toner particles have an average thickness of more than 3 μm, misalignment of the particles may occur, resulting in low reflectivity. The brilliant toner particles preferably have an average thickness of 1 μm or more and 3 μm or less.

The average long-axis length and average thickness of the brilliant toner particles are determined in the following manner: a micrograph of 100 brilliant toner particles is taken with a SEM; these particles on the micrograph are measured for long-axis length and thickness, and the measured values are averaged.

The brilliant toner particles preferably have an average roundness of 0.5 or more and 0.9 or less. When the brilliant toner particles have an average roundness of less than 0.5, the resultant images may have high granularity and graininess. When the brilliant toner particles have an average roundness of more than 0.9, sufficient cleaning may not be achieved due to rolling of the brilliant toner particles. The brilliant toner particles preferably have an average roundness of 0.5 or more and 0.9 or less, more preferably 0.5 or more and 0.8 or less.

The average roundness of the brilliant toner particles is measured with a flow particle image analyzer FPIA-3000 (manufactured by SYSMEX CORPORATION). Specifically, the measurement is performed in the following manner. To 100 ml or more and 150 ml or less of water prepared so as to be free from solid impurities, 0.1 ml or more and 0.5 ml or less of a surfactant (alkylbenzenesulfonate) is added as a dispersing agent, and 0.1 g or more and 0.5 g or less of a measurement sample is added. The suspension containing the dispersed measurement sample is subjected to dispersion treatment using an ultrasonic dispersing device for 1 minute or more and 3 minutes or less such that the dispersion has a concentration of 3000 particles/μl or more and 10000 particles/μ1 or less. The dispersion is measured with the analyzer for the roundness of the brilliant toner particles. The roundness is calculated by the following formula.

$$\text{Roundness}=\text{perimeter of equivalent circle/perimeter}=[2\times(A\pi)^{1/2}]/PM$$

where A represents the projected area, and PM represents the perimeter.

This formula is used to calculate roundness values, and these values are averaged to obtain the average roundness.

The brilliant toner particles preferably have a volume-average particle size of 1 μm or more and 30 μm or less, more preferably 3 μm or more and 20 μm or less.

In particular, the brilliant toner particles preferably have a volume-average particle size of 8 μm or more and 15 μm or less, or about 8 μm or more and about 15 μm or less, from the viewpoint of suppressing occurrence of jamming and increasing the reflectivity of fixed images.

Incidentally, the volume-average particle size $D_{50v}$ is determined in the following manner. The particles are measured with an instrument such as a MULTISIZER II (manufactured by Beckman Coulter, Inc.). In the resultant particle size distribution data, divided particle size ranges (channels) are defined and volume-based and number-based cumulative distribution curves for the channels are individually drawn from the small to large particle sizes. From the curves, the particle sizes read at a cumulative percentage of 16% are defined as $D_{16v}$ (volume-based) and $D_{16p}$ (number-based); the particle sizes read at a cumulative percentage of 50% are defined as $D_{50v}$ (volume-based) and $D_{50p}$ (number-based); and the particle sizes read at a cumulative percentage of 84% are defined as $D_{84v}$ (volume-based) and $D_{84p}$ (number-based). From such values, the volume-based particle size distribution index (GSDv) is calculated by $(D_{84v}/D_{16v})^{1/2}$.

Method for Producing Toner

The brilliant toner may be produced by producing toner particles and adding an external additive to the toner particles. The method for producing the toner particles is not particularly limited and may be performed by a known process, for example, a dry process such as a kneading-pulverization process or a wet process such as an emulsion-aggregation process or a dissolution-suspension process.

Developer

The developer at least contains the above-described brilliant toner. The developer may be a single-component developer containing the brilliant toner alone, or a two-component developer that is a mixture of the brilliant toner and a carrier.

The carrier is not particularly limited and may be selected from known carriers. Examples of the carrier include a coated carrier in which the surfaces of magnetic particles as core materials are covered by a shell resin; a magnetic-powder-dispersed carrier in which a magnetic powder is added to a matrix resin so as to be dispersed; and a resin-impregnated carrier in which a porous magnetic powder is impregnated with a resin. Incidentally, the magnetic-powder-dispersed carrier and the resin-impregnated carrier may each have a powder configuration in which the particles as core materials are covered by a shell resin.

Examples of the magnetic powder include powders of magnetic metals such as iron oxide, nickel, and cobalt; and powders of magnetic oxides such as ferrite and magnetite. Examples of conductive particles include particles of metals such as gold, silver, and copper, carbon black, titanium oxide, zinc oxide, tin oxide, barium sulfate, aluminum borate, and potassium titanate.

Examples of the shell resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing organosiloxane bonds and modified resins thereof, fluororesins, polyester, polycarbonate, phenol resins, and epoxy resins. Incidentally, the shell resin and matrix resin may be prepared so as to contain other additives such as conductive materials.

The surfaces of core materials are covered by such a shell resin by, for example, covering the surfaces with a shell-layer-formation solution containing the shell resin and optionally various additives dissolved in an appropriate solvent. The solvent is not particularly limited and may be selected in accordance with, for example, the shell resin used and coatability.

Specific examples of the method for covering core materials by a shell resin include an immersion method of immersing the core materials into a shell-layer-formation solution; a spraying method of spraying a shell-layer-formation solution to the surfaces of the core materials; a fluidized bed method of spraying a shell-layer-formation solution to the core materials being floated by air flow; and a kneader coater method of, in a kneader coater, mixing the core materials of the carrier and a shell-layer-formation solution and removing the solvent.

In the case of a two-component developer, the mixing ratio (mass ratio) of the brilliant toner to the carrier preferably satisfies toner:carrier=1:100 to 30:100, more preferably 3:100 to 20:100.

EXAMPLES

Hereinafter, exemplary embodiments will be described in detail with reference to examples. However, the exemplary embodiments are not limited to these examples at all. In the following description, "parts" and "%" are all based on mass unless otherwise specified.

Preparation of Developer (1)

Synthesis of Binder Resin

Dimethyl adipate: 74 parts
Dimethyl terephthalate: 192 parts
Bisphenol A ethylene oxide adduct: 216 parts
Ethylene glycol: 38 parts
Tetrabutoxy titanate (catalyst): 0.037 parts These materials are placed into a two-necked flask having been dried by heating. While a nitrogen gas is introduced into the flask to keep the inert atmosphere and the solution is stirred, the temperature of the flask is increased. At 160° C., a copolycondensation reaction is caused for 7 hours. Subsequently, while the pressure is gradually reduced to 10 Torr, the temperature is increased to 220° C. and the system is held for 4 hours. After the system is returned to the ordinary pressure, 9 parts of trimellitic anhydride is added. The pressure is gradually reduced again to 10 Torr and the system is held at 220° C. for 1 hour. Thus, a binder resin is synthesized.

The glass transition temperature (Tg) of the binder resin is determined in accordance with ASTM D3418-8. Specifically, a differential scanning calorimeter (manufactured by SHIMADZU CORPORATION, DSC-50) is used, and the measurement is performed while the temperature is increased from room temperature (25° C.) to 150° C. at a rate of 10° C./min. The glass transition temperature is determined as the temperature at the point of intersection of extensions of the base line and the upward line in the endothermic region. The binder resin is found to have a glass transition temperature of 63.5° C.

Preparation of Resin Particle Dispersion Liquid

Binder resin: 160 parts
Ethyl acetate: 233 parts
Sodium hydroxide aqueous solution (0.3 N): 0.1 parts These materials are placed into a 1000-ml separable flask, heated at 70° C., and stirred with a three-one motor (manufactured by Shinto Scientific Co., Ltd.) to prepare a resin mixture. While this resin mixture is stirred at 90 rpm, 373 parts of ion-exchanged water is gradually added to cause phase inversion emulsification. The resultant emulsion is subjected to removal of the solvent to obtain a resin particle dispersion liquid (solid content: 30%). The resin particle dispersion liquid is found to have a volume-average particle size of 162 nm.

Preparation of Release Agent Dispersion Liquid

Carnauba wax (manufactured by TOA KASEI CO., LTD., RC-160): 50 parts
Anionic surfactant (Neogen RK, manufactured by DAI-ICHI KOGYO SEIYAKU CO., LTD.): 1.0 part
Ion-exchanged water: 200 parts These materials are mixed together, heated at 95° C., subjected to a dispersion treatment with a homogenizer (manufactured by IKA-Werke GmbH & Co. KG, ULTRA-TURRAX T50), and subjected to another dispersion treatment with a Manton Gaulin high-pressure homogenizer (manufactured by Gaulin company) for 360 minutes, to thereby prepare a release agent dispersion liquid (solid content: 20%) in which release agent particles having a volume-average particle size of 0.23 μm are dispersed.

Preparation of Metal Pigment Particle Dispersion Liquid

Aluminum pigment (manufactured by SHOWA ALUMINUM POWDER K.K., 2173EA): 100 parts
Anionic surfactant (manufactured by DAI-ICHI KOGYO SEIYAKU CO., LTD., Neogen R): 1.5 parts
Ion-exchanged water: 900 parts The aluminum pigment paste is subjected to removal of the solvent, and then mixed with the other materials to achieve dissolution. The resultant liquid is subjected to dispersion treatment with a dispersion emulsifier CAVITRON (manufactured by Pacific Machinery & Engineering Co., Ltd., CR1010) for about 1 hour to prepare a metal pigment particle dispersion liquid (solid content: 10%) in which metal pigment particles (aluminum pigment) are dispersed. The aluminum pigment (metal pigment) is found to have an average long-axis length of 8 μm and an average thickness of 0.1 μm.

Preparation of Brilliant Toner (1)

Resin particle dispersion liquid: 380 parts
Release agent dispersion liquid: 72 parts
Metal pigment particle dispersion liquid: 140 parts These metal pigment particle dispersion liquid, resin particle dispersion liquid, and release agent dispersion liquid are placed into a 2-L cylindrical stainless steel vessel, dispersed and mixed for 10 minutes under application of a shear force with a homogenizer (manufactured by IKA-Werke GmbH & Co. KG, ULTRA-TURRAX T50) rotated at 4000 rpm. Subsequently, 1.75 parts of 10% nitric acid aqueous solution of polyaluminum chloride as an aggregating agent is gradually dropped, and the resultant liquid is dispersed and mixed with the homogenizer rotated at 5000 rpm for 15 minutes. Thus, a raw material dispersion liquid is prepared.

The raw material dispersion liquid is transferred into a polymerization reactor equipped with a thermometer and a stirring device using two paddle impellers. The liquid is stirred at 810 rpm and heated with a mantle heater to cause growth of aggregation particles at 54° C. At this time, a 0.3 N nitric acid aqueous solution and a 1 N sodium hydroxide aqueous solution are used to control the pH of the raw material dispersion liquid to be in the range of 2.2 to 3.5. The liquid is maintained in this pH range for about 2 hours to form aggregation particles.

Subsequently, the resin particle dispersion liquid is further added, to cause resin particles of the binder resin to adhere to the surfaces of the aggregation particles. The temperature is increased to 56° C., and the aggregation particles are adjusted while the sizes and shapes of the particles are observed with an optical microscope and a MUTISIZER II. Subsequently, in order to fuse the aggregation particles together, the pH is increased to 8.0, and the temperature is then increased to 67.5° C. After fusion of aggregation particles is confirmed with the optical microscope, the pH is decreased to 6.0 while the temperature is maintained at 67.5° C. After a lapse of 1 hour, the heating is stopped and the system is cooled at a cooling rate of 0.1° C./min. The resultant substance is shifted through a 20 μm mesh, washed with water several times, and dried with a vacuum dryer to obtain toner particles (1).

The toner particles are further heated with a hot-air dryer at 45° C. for 1 hour.

The heated toner particles (100 parts) are mixed with 1.5 parts of hydrophobic silica (manufactured by NIPPON AEROSIL CO., LTD., RY50) and 1.0 part of hydrophobic titanium oxide (manufactured by NIPPON AEROSIL CO., LTD., T805) with a sample mill at 10000 rpm for 30 seconds. The resultant substance is shifted with a vibrating strainer with a sieve opening of 45 μm to thereby prepare a brilliant toner (1).

The brilliant toner (1) is found to have a volume-average particle size of 12.2 μm, an average long-axis length of 15 μm, an average thickness of 1.5 μm, an average roundness of 0.6, and a charge amount Q per particle of $1.8\times10^{-13}$ C/particle.

Preparation of Carrier

Ferrite particles (volume-average particle size: 35 μm): 100 parts

Toluene: 14 parts

Perfluorooctyl ethyl acrylate/methyl methacrylate copolymer: 1.6 parts

Carbon black (trade name: VXC-72, manufactured by Cabot Corporation): 0.12 parts Cross-linked melamine resin particles (average particle size: 0.3 μm, insoluble in toluene): 0.3 parts The carbon black is diluted with toluene, added to the perfluorooctyl ethyl acrylate/methyl methacrylate copolymer, and dispersed with a sand mill. In the resultant dispersion, the above-described materials other than the ferrite particles are dispersed with a stirrer for 10 minutes to prepare a shell-layer-formation solution. This shell-layer-formation solution and the ferrite particles are placed into a vacuum degassing kneader, stirred at 60° C. for 30 minutes, and then subjected to a reduction in the pressure to evaporate toluene to thereby form resin shell layers. Thus, a carrier is obtained.

Preparation of Developer (1)

The toner (36 parts) and 414 parts of the carrier are placed into a 2-liter V blender, stirred for 20 minutes, and then shifted with a sieve opening of 212 μm. Thus, the developer is prepared.

Preparation of Developer (2)

A brilliant toner (2) is prepared as with the brilliant toner (1) except that, in the preparation of the brilliant toner (1), the aluminum pigment (metal pigment) is changed such that the average long-axis length is 10.3 μm and the average thickness is 0.32 μm.

The brilliant toner (2) is found to have a volume-average particle size of 13.7 μm, an average long-axis length of 17.0 μm, an average thickness of 2.3 μm, an average roundness of 0.56, and a charge amount Q per particle of $2.4\times10^{-13}$ C/particle.

The brilliant toner (2) is used to prepare a developer (2) as with the developer (1).

Preparation of Developer (3)

A brilliant toner (3) is prepared as with the brilliant toner (1) except that, in the preparation of the brilliant toner (1), the aluminum pigment (metal pigment) is changed such that the average long-axis length is 12.0 μm and the average thickness is 0.5 μm.

The brilliant toner (3) is found to have a volume-average particle size of 15.0 μm, an average long-axis length of 20 μm, an average thickness 3.0 μm, an average roundness of 0.5, and a charge amount Q per particle of $3.0\times10^{-13}$ C/particle.

The brilliant toner (3) is used to prepare a developer (3) as with the developer (1).

Preparation of Developer (4)

A brilliant toner (4) is prepared as with the brilliant toner (1) except that, in the preparation of the brilliant toner (1), the aluminum pigment (metal pigment) is changed such that the average long-axis length is 5.0 μm and the average thickness is 0.01 μm.

The brilliant toner (4) is found to have a volume-average particle size of 8.0 μm, an average long-axis length of 7.0 μm, an average thickness of 1.0 μm, an average roundness of 0.9, and a charge amount Q per particle of $0.6\times10^{-13}$ C/particle.

The brilliant toner (4) is used to prepare a developer (4) as with the developer (1).

Preparation of Developer (5)

A brilliant toner (5) is prepared as with the brilliant toner (1) except that, in the preparation of the brilliant toner (1), the aluminum pigment (metal pigment) is changed such that the average long-axis length is 6.4 μm and the average thickness is 0.07 μm.

The brilliant toner (5) is found to have a volume-average particle size of 9.3 μm, an average long-axis length of 12.0 μm, an average thickness of 1.2 μm, an average roundness of 0.78, and a charge amount Q per particle of $1.2\times10^{-13}$ C/particle.

The brilliant toner (5) is used to prepare a developer (5) as with the developer (1).

Preparation of Developer (6)

A brilliant toner (6) is prepared as with the brilliant toner (1) except that, in the preparation of the brilliant toner (1), the aluminum pigment (metal pigment) is changed such that the average long-axis length is 7.1 μm and the average thickness is 0.09 μm.

The brilliant toner (6) is found to have a volume-average particle size of 11.0 μm, an average long-axis length of 10.5 μm, an average thickness of 1.4 μm, an average roundness of 0.72, and a charge amount Q per particle of $1.6\times10^{-13}$ C/particle.

The brilliant toner (6) is used to prepare a developer (6) as with the developer (1).

Preparation of Developer (7)

A brilliant toner (7) is prepared as with the brilliant toner (1) except that, in the preparation of the brilliant toner (1), the aluminum pigment (metal pigment) is changed such that the average long-axis length is 4.0 μm and the average thickness is 0.09 μm.

The brilliant toner (7) is found to have a volume-average particle size of 7.0 μm, an average long-axis length of 6 μm, an average thickness of 1.2 μm, an average roundness of 0.9, and a charge amount Q per particle of $0.5\times10^{-13}$ C/particle.

The brilliant toner (7) is used to prepare a developer (7) as with the developer (1).

Preparation of Developer (8)

A brilliant toner (8) is prepared as with the brilliant toner (1) except that, in the preparation of the brilliant toner (1), the aluminum pigment (metal pigment) is changed such that the average long-axis length is 14 μm and the average thickness is 0.09 μm.

The brilliant toner (8) is found to have a volume-average particle size of 18.0 μm, an average long-axis length of 22.5 μm, an average thickness of 1.4 μm, an average roundness of 0.72, and a charge amount Q per particle of $4.7\times10^{-13}$ C/particle.

The brilliant toner (8) is used to prepare a developer (8) as with the developer (1).

Examples 1 to 21 and Comparative Examples 1 to 6

The developers summarized in Tables 1 and 2 are charged into the developing devices of image forming apparatuses manufactured by Fuji Xerox Co., Ltd. "Fuji Xerox Color 1000 Press, modified version (the direct current voltage applied to each developing member is set to 400 V)". In each image forming apparatus, the amount M [g/m$^2$] of the developer carried by the developing member and the gap width L [μm] between the photoconductor (image carrier) and the developing member are set as described in Tables 1 and 2. Thus, image forming apparatuses of Examples and Comparative Examples are prepared.

Each image forming apparatus is used to output 1000 sheets of 4A-sized paper (OK Topcoat 128, manufactured by Oji Paper Co., Ltd.) such that each sheet has a strip-shaped solid image (solid image with a toner application amount (developing amount using toner) of 4.5 g/m$^2$) extending in the paper transport direction under fixing conditions of a fixing temperature of 190° C. and a fixing pressure of 4.0 kg/cm$^2$. The fixed images are evaluated in the following manner.

Reflectivity of Fixed Images

The reflectivity (FI) of such a fixed image is measured in the following manner. The region of the formed solid image is measured with a variable angle photometer that is a spectroscopic variable-angle color-difference meter GC5000L, manufactured by NIPPON DENSHOKU INDUSTRIES CO., LTD. Specifically, the solid image is irradiated with incident light at an incident angle of −45°, and a reflectance A at a light receiving angle of +30° and a reflectance B at a light receiving angle of −30° are measured. Incidentally, the reflectance A and the reflectance B are each measured with light of wavelengths of 400 nm to 700 nm in steps of 20 nm, and determined as the average of the measured reflectances at the individual wavelengths. From the measurement results, the ratio A/B is calculated as the reflectivity (FI).

Evaluation System

A: FI is 7.0 or more.

B: FI is 6.0 to 6.9.

C: FI is 5.0 to 5.9.

D: FI is less than 5.0.

Jamming

Evaluation in terms of jamming is performed in the following manner.

The modified version of Fuji Xerox COLOR 1000 PRESS is used to continuously output 1000 sheets of A3-sized J paper such that each sheet has a halftone image over the whole surface with an area coverage of 30%. The evaluation is performed by visual inspection for the presence or absence of white spots or white streaks on such halftone images and the developer-carrying state of the developing member after output of 1000 sheets. The evaluation system is as follows.

Evaluation System

A: No problem in image quality and developing member

B: No problem in image quality but a sign of jamming in the developing member

C: Problem in image quality that is occurrence of minor white spots and white streaks D: Problem in image quality that is occurrence of white spots and white streaks Tables 1 and 2 below summarize details and evaluation results of Examples and Comparative Examples.

TABLE 1

| | Developer | | Amount M [g/m$^2$] of developer carried by developing member | Gap width L [μm] between photoconductor and developing member | | Evaluation | |
|---|---|---|---|---|---|---|---|
| | Species | Charge amount Q per particle of brilliant toner [C/particle] | | | M/L | Reflextivity of fixed images | Jamming |
| Example 1 | (1) | $1.8\times10^{-13}$ | 150 | 185 | 0.8 | A | A |
| Example 2 | (1) | $1.8\times10^{-13}$ | 200 | 190 | 1.1 | A | A |
| Example 3 | (1) | $1.8\times10^{-13}$ | 250 | 200 | 1.3 | A | A |
| Example 4 | (1) | $1.8\times10^{-13}$ | 300 | 215 | 1.4 | A | B |
| Example 5 | (1) | $1.8\times10^{-13}$ | 200 | 150 | 1.3 | A | A |
| Example 6 | (1) | $1.8\times10^{-13}$ | 300 | 300 | 1.0 | A | A |
| Example 7 | (2) | $2.4\times10^{-13}$ | 300 | 215 | 1.4 | B | B |
| Example 8 | (2) | $2.4\times10^{-13}$ | 200 | 190 | 1.1 | B | A |
| Example 9 | (2) | $2.4\times10^{-13}$ | 150 | 185 | 0.8 | B | A |
| Example 10 | (3) | $3.0\times10^{-13}$ | 300 | 215 | 1.4 | B | B |
| Example 11 | (3) | $3.0\times10^{-13}$ | 200 | 190 | 1.1 | B | A |
| Example 12 | (3) | $3.0\times10^{-13}$ | 150 | 185 | 0.8 | B | A |
| Example 13 | (4) | $0.6\times10^{-13}$ | 300 | 215 | 1.4 | A | B |
| Example 14 | (4) | $0.6\times10^{-13}$ | 200 | 190 | 1.1 | A | A |
| Example 15 | (4) | $0.6\times10^{-13}$ | 150 | 185 | 0.8 | A | A |
| Example 16 | (5) | $1.2\times10^{-13}$ | 300 | 215 | 1.4 | A | B |
| Example 17 | (5) | $1.2\times10^{-13}$ | 200 | 190 | 1.1 | A | A |

TABLE 1-continued

| | Developer | | Amount M [g/m$^2$] of developer carried by developing member | Gap width L [μm] between photoconductor and developing member | | Evaluation | |
|---|---|---|---|---|---|---|---|
| | Species | Charge amount Q per particle of brilliant toner [C/particle] | | | M/L | Reflextivity of fixed images | Jamming |
| Example 18 | (5) | $1.2 \times 10^{-13}$ | 150 | 185 | 0.8 | A | A |
| Example 19 | (6) | $1.6 \times 10^{-13}$ | 300 | 215 | 1.4 | A | B |
| Example 20 | (6) | $1.6 \times 10^{-13}$ | 200 | 190 | 1.1 | A | A |
| Example 21 | (6) | $1.6 \times 10^{-13}$ | 150 | 185 | 0.8 | A | A |

TABLE 2

| | Developer | | Amount M [g/m$^2$] of developer carried by developing member | Gap width L [μm] between photoconductor and developing member | | Evaluation | |
|---|---|---|---|---|---|---|---|
| | Species | Charge amount Q per particle of brilliant toner [C/particle] | | | M/L | Reflextivity of fixed images | Jamming |
| Comparative Example 1 | (1) | $1.8 \times 10^{-13}$ | 145 | 160 | 0.9 | D | A |
| Comparative Example 2 | (1) | $1.8 \times 10^{-13}$ | 305 | 250 | 1.2 | C | D |
| Comparative Example 3 | (1) | $1.8 \times 10^{-13}$ | 200 | 275 | 0.7 | D | A |
| Comparative Example 4 | (1) | $1.8 \times 10^{-13}$ | 275 | 185 | 1.5 | C | D |
| Comparative Example 5 | (7) | $0.5 \times 10^{-13}$ | 250 | 200 | 1.3 | D | A |
| Comparative Example 6 | (8) | $4.7 \times 10^{-13}$ | 250 | 200 | 1.3 | D | A |

The results indicate that Examples, which satisfy Formulae (1) to (3), enable suppression of occurrence of jamming and also formation of highly brilliant fixed images, in contrast to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a charging device that charges a surface of the image carrier;

an electrostatic image forming device that forms an electrostatic image on the surface of the image carrier;

a developing device including a container that stores an electrostatic image developer containing a brilliant toner containing a substantially flake shape metal pigment, a developing member that is disposed so as to face, with a gap width, the image carrier and that develops the electrostatic image on the surface of the image carrier to form a toner image, and a voltage application unit that applies a direct current voltage to the developing member;

a transfer device that transfers the toner image on the surface of the image carrier onto a surface of a recording medium; and a fixing device that fixes the transferred toner image on the surface of the recording medium, the image forming apparatus satisfying relationships represented by Formulae (1) to (3) below $$0.6\times10^{-13}C/\text{particle}\ S\leq Q\leq 3.0\times10^{-13}\ C/\text{particle} \quad \text{Formula (1):}$$

$$150\ \text{g/m}^2\leq M\leq 300\ \text{g/m}^2 \quad \text{Formula (2):}$$

$$0.8\leq M/L\leq 1.4 \quad \text{Formula (3):}$$

where Q represents a charge amount per particle [C/particle] of the brilliant toner, M represents an amount [g/m$^2$] of the electrostatic image developer carried by the developing member, and L represents the gap width [μm] between the image carrier and the developing member.

2. The image forming apparatus according to claim 1, wherein the substantially flake shape metal pigment has an average long-axis, length of about 5 μm to about 12 μm and has an average thickness of about 0.01 μm to about 0.5 μm.

3. The image forming apparatus according to claim 1, wherein the brilliant toner has a volume-average particle size of about 8 μm to about 15 μm.

4. The image forming apparatus according to claim 1, wherein the gap width between the image carrier and the developing member is about 150 μm to about 300 μm.

5. The image forming apparatus according to claim 1, wherein the amount of the electrostatic image developer carried by the developing member is about 175 $g/m^2$ to about 275 $g/m^2$.

6. The image forming apparatus according to claim 1, wherein the charge amount per particle of the brilliant toner is about $1.0\times10^{-13}$ C/particle to about $2.5\times10^{-13}$ C/particle.

* * * * *